US009302847B2

(12) United States Patent
Cudworth et al.

(10) Patent No.: US 9,302,847 B2
(45) Date of Patent: Apr. 5, 2016

(54) WASTE STORAGE DEVICE

(75) Inventors: Nicholas Cudworth, Cramlington (GB); David Akerman, Cramlington (GB); Jonathon Knox, Cramlington (GB)

(73) Assignee: Sangenic International, Ltd., Northumberland (GB)

( * ) Notice: Subject to any disclaimer, the term of this patent is extended or adjusted under 35 U.S.C. 154(b) by 1010 days.

(21) Appl. No.: 13/138,403

(22) PCT Filed: Feb. 5, 2010

(86) PCT No.: PCT/GB2010/000207

§ 371 (c)(1), (2), (4) Date: Dec. 12, 2011

(87) PCT Pub. No.: WO2010/092325

PCT Pub. Date: Aug. 19, 2010

(65) Prior Publication Data

US 2012/0073250 A1 Mar. 29, 2012

(30) Foreign Application Priority Data

Feb. 13, 2009 (GB) ..... 0902471.2

(51) Int. Cl.
*B65B 9/10* (2006.01)
*B65F 1/06* (2006.01)

(52) U.S. Cl.
CPC ..... *B65F 1/062* (2013.01); *B65F 2210/1675* (2013.01); *B65F 2240/132* (2013.01)

(58) Field of Classification Search
CPC .... B65F 1/062; B65F 2210/167; B65B 43/60
USPC ..... 53/432, 471, 485, 488, 489, 510, 511, 53/545, 281
See application file for complete search history.

(56) References Cited

U.S. PATENT DOCUMENTS 3,643,586 A * 2/1972 Robinson ..... A23L 3/02 53/510
3,653,176 A * 4/1972 Gess ..... B65B 43/50 156/384
3,904,361 A * 9/1975 Egger ..... B65B 55/103 118/643
4,614,073 A * 9/1986 Argazzi ..... B65B 19/34 53/446

(Continued)

FOREIGN PATENT DOCUMENTS

EP 2045197 4/2009
GB 2206094 12/1988

(Continued)

OTHER PUBLICATIONS

Written Opinion of International Search Report. Jun. 16, 2010.

(Continued)

*Primary Examiner* — Robert Long
(74) *Attorney, Agent, or Firm* — Olson & Cepuritis, Ltd.

(57) ABSTRACT

A cassette support portion (706) is provided for supporting a cassette (701) containing film (702) on a support (704) for rotation in a waste storage device. The cassette support portion (706) includes a support contacting portion (740) and a cassette contacting portion (742) angled inwardly therefrom. There is further provided a cassette support (704) including said cassette support portion (706), a cassette (701) mounted on said cassette support portion (706) and a waste storage device including said cassette support (704) and support portion (706).

15 Claims, 9 Drawing Sheets

(56) References Cited

U.S. PATENT DOCUMENTS

| | | | | |
|---|---|---|---|---|
| 4,729,206 | A * | 3/1988 | Francis | B65B 7/2878 53/297 |
| 4,869,049 | A * | 9/1989 | Richards et al. | 53/459 |
| 5,704,886 | A * | 1/1998 | Sampaolo | B31B 1/25 493/399 |
| 6,128,890 | A * | 10/2000 | Firth | 53/567 |
| 6,925,781 | B1 * | 8/2005 | Knuth | B65F 1/062 53/370 |
| 7,003,934 | B1 * | 2/2006 | Yano | B29C 65/3656 53/374.2 |
| 7,594,376 | B2 * | 9/2009 | Chomik | B65B 7/12 53/370 |
| 7,694,493 | B2 * | 4/2010 | Stravitz | B65B 67/1277 53/138.7 |
| 7,712,285 | B2 * | 5/2010 | Stravitz | B65F 1/12 200/61.62 |
| 7,743,588 | B2 | 6/2010 | Webb et al. | |
| 7,958,704 | B2 * | 6/2011 | Stravitz et al. | 53/567 |
| 8,613,371 | B2 * | 12/2013 | Rousso | B65F 1/062 220/264 |
| 8,783,499 | B2 * | 7/2014 | Lacy et al. | 220/495.06 |
| 2004/0083681 | A1 * | 5/2004 | Stravitz | 53/138.1 |
| 2005/0193692 | A1 * | 9/2005 | Stravitz et al. | 53/567 |
| 2006/0130438 | A1 * | 6/2006 | Stravitz et al. | 53/567 |
| 2006/0130439 | A1 * | 6/2006 | Stravitz | B65B 9/15 53/567 |
| 2008/0206096 | A1 * | 8/2008 | Deka | A61L 2/202 422/28 |
| 2008/0272140 | A1 | 11/2008 | Mowers et al. | |
| 2011/0011608 | A1 * | 1/2011 | Saur | B25D 11/062 173/162.2 |
| 2011/0099954 | A1 * | 5/2011 | Cudworth | 53/510 |
| 2011/0154779 | A1 * | 6/2011 | Baba | B29C 65/02 53/111 R |
| 2011/0232240 | A1 * | 9/2011 | Lacy | B65F 1/062 53/576 |
| 2012/0186193 | A1 * | 7/2012 | Frabetti et al. | 53/281 |
| 2012/0311974 | A1 * | 12/2012 | Stravitz et al. | 53/526 |

FOREIGN PATENT DOCUMENTS

| | | |
|---|---|---|
| GB | 2292725 | 3/1996 |
| GB | 2402347 | 12/2004 |
| WO | 9939995 | 8/1999 |
| WO | 2005042381 | 5/2005 |
| WO | 2010092325 | 8/2010 |

OTHER PUBLICATIONS

International Search Report; Jun. 16, 2010.

* cited by examiner

WASTE STORAGE DEVICE

The invention relates to a waste storage device and elements of or for use therewith including a waste storage cassette and cassette support portion.

One known waste storage device is disclosed in GB Patent No. 2206094 incorporated herein by reference and described here with reference to FIG. 1. The device is particularly useful for the storage for subsequent disposal of waste such as babies' nappies or other personal waste material. A plastics container 21 is formed with an internal flange 22 from which a cylinder 23 extends upwards. A pack consisting of a tubular core 1 inside a profusely circumferentially pleated length of flexible tubing 2 is located in the container 21 with the core 1 resting on the flange 22 and rotatable on the cylinder 23. To begin using the pack to form a series of packages of objects, which in this particular example will be considered to be babies' disposable nappies, the top of the flexible tubing 2 is pulled upwards and tied into a knot 24. This closed end can then form the bottom of a package to be formed along the length of part of the tubing. This is effected by pushing the closed end downwards inside the core 1 and cylinder 23 by the object to be packaged. As this is being done the flexible tubing 2 from the pleated length slides over the top edge 25 (FIG. 1) of the core 1 which is made sufficiently smooth to prevent the flexible tubing from being damaged. The core 1 may be approximately four inches (10.16 cm) diameter but, of course, the diameter of the flexible tubing 2 is substantially more than this.

When the object has been thrust well into the concentric core 1 and cylinder 23, the package is closed by twisting the flexible tubing 2 above the object as at 30 (FIG. 1). This is done by turning the core 1 with remaining pleated tubing thereon about the core axis.

GB 2206094 and GB2292725 also incorporated herein by reference both additionally disclose a cutting arrangement for severing the tubing when it is desired to remove the packages for disposal. Referring to FIG. 2, the severing means is incorporated in the unit 31 which is a bipartite unit comprising an outer ring 55 formed with a flange 50 that locks into the top of the core 1 or funnel 12 and a disc 56 which is freely rotatable in the ring 55. The disc 56 comprises a circular transparent sheet 57, through which the user can see the twisted flexible tubing, set in an angle section ring having a horizontal flange 58 and a vertical flange 59 (FIG. 1) located between narrow flanges inside the relatively stationary flange 50. In the angle of the ring 58, 59 three finger pieces 60 are fixed 120° apart above the transparent sheet 57. A cutter unit 61 is fixed beneath the flange 58. This device has an upper arcuate part 62 and a lower tapered shoe 63 with a gap between them along the major portion of their length. Close to the closed termination of this gap a metal cutter blade 64 is fixed as close as possible to the relatively stationary flange 50 so that the blade is shrouded against doing any damage to a person's fingers when the lid 31 is removed. The predominant material for the lid may be plastics material or metal.

To operate the cutter unit 61, the disc 56 is turned by means of the finger pieces 60 or any other suitable finger pieces through a full revolution. In this movement the tapered shoe 63 pierces through the radially pleated taut portion 65 of the flexible tubing that flares outwards from the topmost twist 30 to the core 1. Further rotation of the disc 56 causes the cutter blade 64 to cut round the tubing material, cleanly separately the uppermost package from the flexible tubing remaining on the core 1. The cutter unit further includes a finger releasable detent operable at 120° intervals.

In a further improvement, WO99/39995 incorporated herein by reference describes a cutter of similar type to that described above with reference to FIG. 2 but formed integrally with a hinged lid for a waste storage container. The hinged lid swings down to close the container and as a result the cutter automatically engages the tubing allowing a simplified cutting arrangement. A further improved device is disclosed in WO2005/042381 the contents of which are incorporated herein by reference. A waste storage device carries a rotatable support comprising an outer rotatable disk with a user grip portion. The disk engages the cassette for rotation of the cassette without the need to touch the cassette itself or the tubing. The device can be understood in more detail with reference to FIGS. 3 to 6.

The device includes a rotatable spinner or disk 100 with a handle 102. The disk 100 is mounted for a rotation on an annular rim 104 of a formation on the container 21. The cassette 1 has an annular flange 106 around its outer wall resting on the shoulder 104 such that rotation of the disk 100 rotates the cassette to provide the twist in the tubing 2. In an alternative embodiment (not shown) the annular flange 106 on the cassette rests on a formation in the container itself and the disk 100 includes formations such as lugs engaging co-operating formations such as notches in the cassette. In either event a simpler means of rotating the cassette, and with less resistance to rotation, is provided.

A hinged lid 70 is further provided on the container 21. The hinged lid 70 includes an integral cutter 57 which engages the tubing 2 against the funnel 12 when the lid 70 is closed to allow cutting of the tubing in the manner discussed above with regard to FIG. 2. The specific configuration of the cutter according to the present invention is described in more detail below.

The container further includes an upper gripping diaphragm 120 and a lower, guide diaphragm 122 mounted on appropriate formations on the container provided in a throat portion of the container 21 below the cassette and formed of flexible material. The upper gripping diaphragm 120 has a central aperture which can be for example circular or circular with lobes as discussed in more detail below and is arranged to hold a package against rotation of the cassette by the rotating disk 100. The lower guide diaphragm 122 has a V-shaped slit ensuring that when a package 35 is pushed through it is directed towards, and engages, the side of the container 21 to prevent rotation and untwisting. It will be seen that the diaphragm 122 directs the package 35 towards a side having an additional set-in inner wall or fluted portion 21*a* to facilitate contact with the package 35. It will be noted that the hinged lid, rotating disk, cassette and upper and lower diaphragms are all provided on a top portion of the container 21 which can be removed from a lower portion of the container 21 to allow removal of waste stored in the container 21. The two parts can be held together by any appropriate catch means, and optionally the catch also provides an integral handle for moving the container as a whole.

The rotatable disk and cassette assembly is described in more detail with reference to FIGS. 4 and 5. The rotatable disk 100 includes an upper annulus 110 carrying a post upon which the handle 102 is mounted to spin freely for ease of rotation of the disk 100 by a user. An outer cylindrical wall 112 depends from the annulus 110, the lower face of which is supported on a support face of the container as can be seen in FIG. 3. An inner cylindrical wall 114 depends from an inner edge of the annulus 110 and has an inwardly projecting annular support flange 115 providing the shoulder 104 at its base supporting, as can be seen from FIG. 5, the cassette 1. The cassette 1 has an outwardly projecting annular flange or lip 116 on its outer wall resting on the support flange 115. In addition a lug 118 projecting from a lower face of the outer cylindrical wall engages in a recess or aperture 119 in the cassette 1 ensuring full rotational engagement. The recess 119 can, for example, also serve as a vent allowing air to escape when tubing is inserted into the cassette during the manufacturing process. Alternatively the cassette can carry a plurality of axially directed ribs around its outer periphery which engage with a co-operating lug or other formation on the rotatable disk 100. The upper annulus 110 can include a cutaway portion allowing the user to access the tubing to pull it out and through the central aperture of the cassette. The tubing may also carry colouring or another indicator at its lower end as an out-of-stock indicator to display to the user when it is nearly depleted.

Referring now to FIG. 6 the hinged lid 70 can be seen in more detail as including a disk-shaped rim portion 250 having an external downwardly curved peripheral lip 252 and a downwardly domed inner periphery portion 254 forming a central circular aperture having an inner generally horizontal annular flange 202 with an inner upwardly projecting cylindrical guide lip 204. The cutter 57 includes a handle portion 206 comprising a generally circular body with appropriate grip portions (not shown) mounted rotatably against the hinged lid guide lip 204 and comprising a co-operating inner lip 208 engaging against the guide lip 204 to form a rotation guide. Depending from the handle portion 206 a cutter portion 210 comprises a cylindrical disk 212 with a shoe 214 projecting there from carrying a blade (not shown) as discussed in more detail above with reference to FIG. 2. Rotation of the handle portion 206 turns the cutter portion 210 relative to the tubing such that the shoe 214 catches the tubing 2 which rides up to the blade and is cut by continued rotation of the cutter. In an optimisation two blades and respective shoes are provided at 180° intervals around the cutter ensuring that the film is cut all the way around with a single turn of the cutter.

Existing designs fit a limited range of cassettes and additional flexibility may in some instances be required.

The invention is set out in the claims.

Embodiments of the invention will now be described, by way of example, with reference to the drawings of which:

Figure 10A:
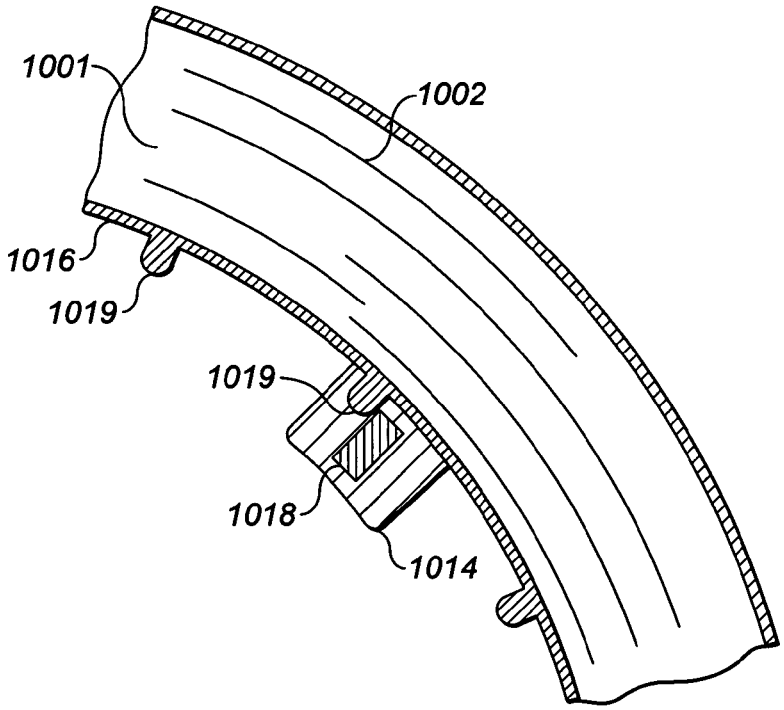
Figure 10B:
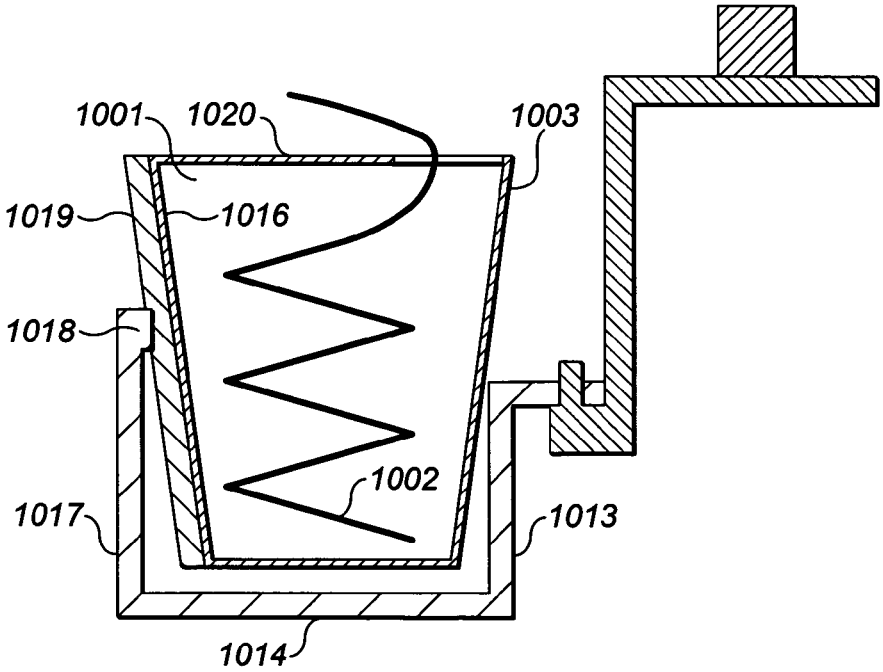

FIG. 10*a* is a schematic partial plan view of a cassette support portion according to a fourth aspect to the first embodiment of the present invention;

FIG. 10*b* is a cutaway side view of the embodiment of FIG. 10*a;*

Figure 11:
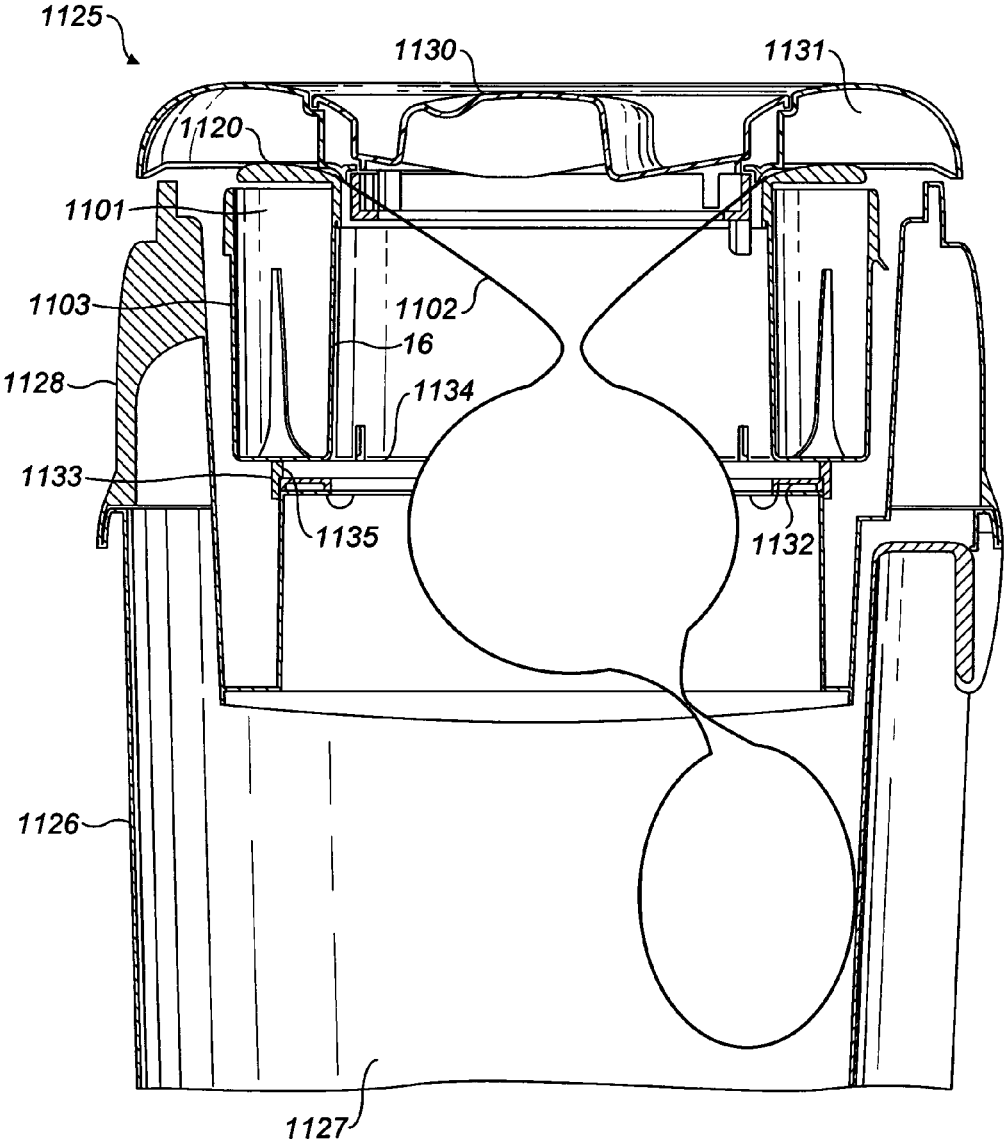
Figure 11A:
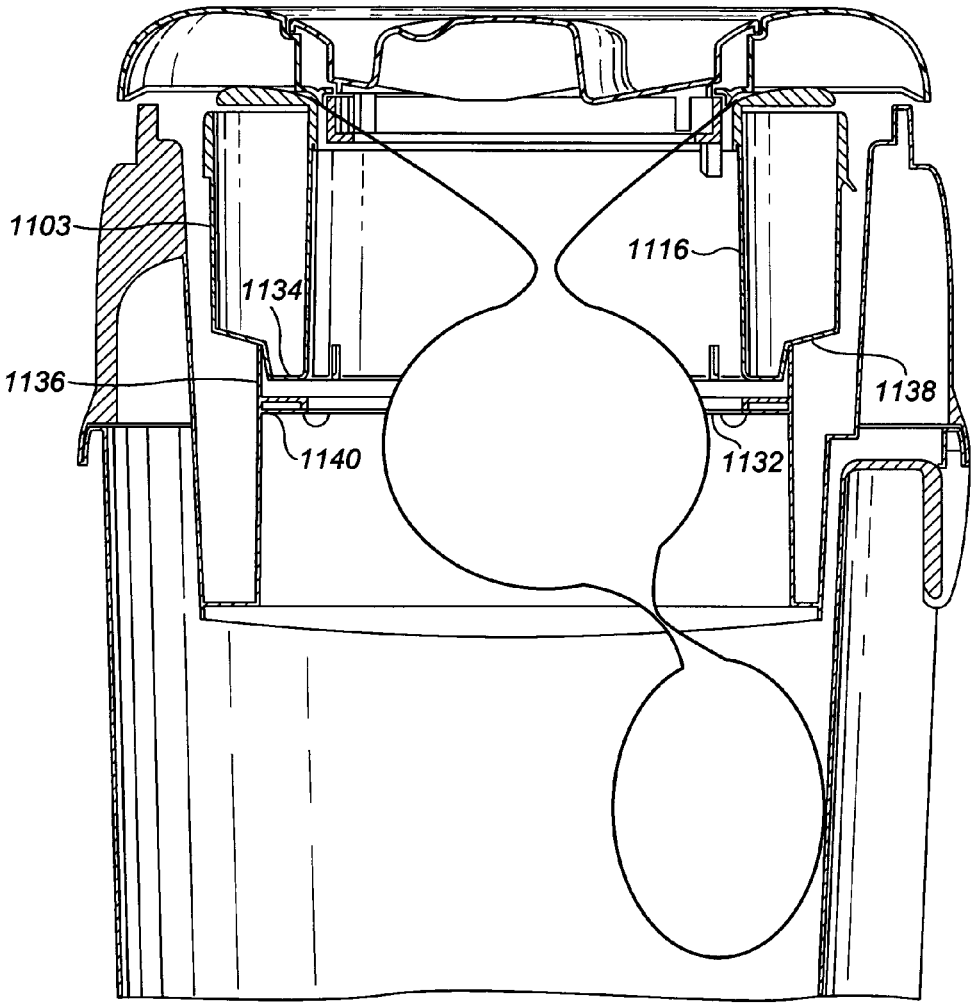
Figure 12:
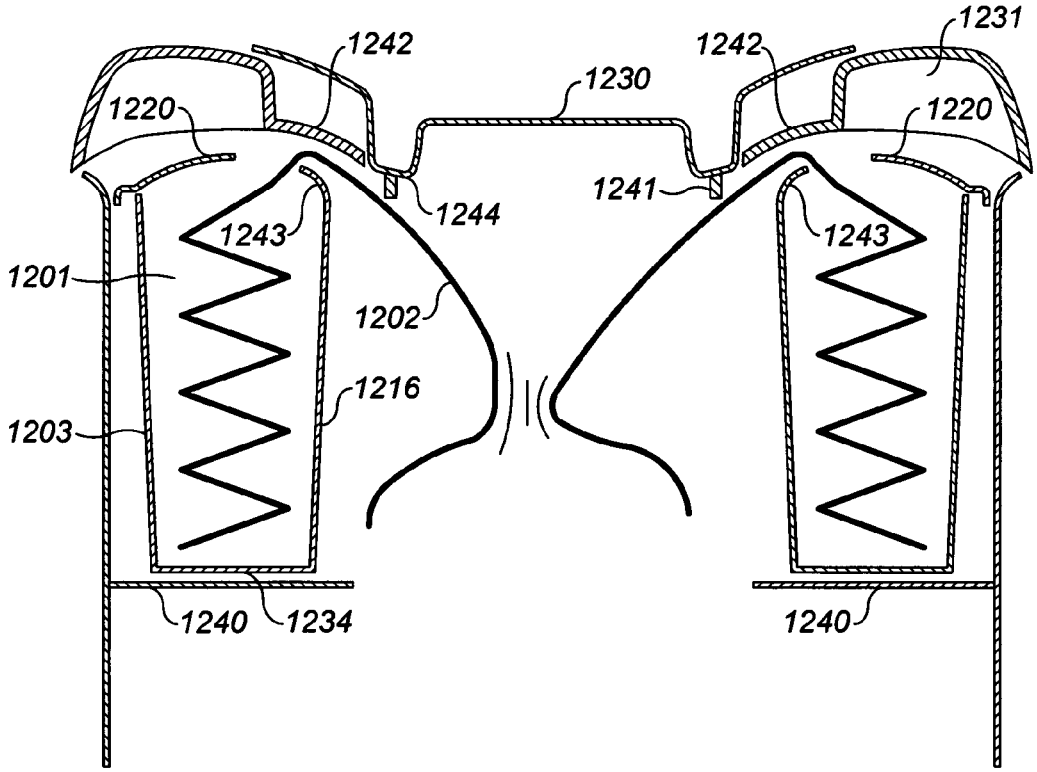

FIG. 11 is a cutaway view a first aspect of a waste storage device according to a second embodiment of the present invention;

FIG. 11*a* is a cutaway view of a waste storage device according to an alternative first aspect to the second embodiment of the present invention; and FIG. 12 is a schematic sectional view of a waste storage device according to a second aspect of the second embodiment of the invention.

In overview, the present invention relates to additional features of a waste storage device, waste storage cassette or cassette support allowing the user more flexibility in cassette selection. The user is able to rotate the cassette and hence seal nappies within the film according to two embodiments.

In the first embodiment the cassette walls are gripped with a feature on the rotate ring of the rotator acting as support. For example this would be an angled or resilient feature, or may engage alternative parts of the cassette. The feature can be integral with the rotate ring or can be incorporated into an additional support portion that readily fits to the existing rotate ring.

According to a second embodiment the support or rotate ring can be dispensed with and a manually rotatable cassette can be provided which is self centred on the supporting shelf in the waste storage device by virtue of features of the cassette or the waste storage device, so as to ensure that the cassette still functions with the cutter in the lid.

It will be noted that the arrangements described herein can act in conjunction, for example, with known devices including the so called Sangenic Mark III device which is described above in relation to WO2005/042381. As discussed this document discloses a cassette which hangs on to rotate ring or support via a ledge on the outer wall of the cassette cooperatively engaging with the rim on the inner wall of the rotate ring allowing the user to easily rotate the cassette so that the film dispenser from the cassette can be twisted to effect an airtight seal above waste packages.

It will be noted, however, that the arrangements described herein can be used in relation to any appropriate waste storage device or comprise modifications of such a device. For example modified devices in which the diaphragms 120, 122 are replaced by a single upper diaphragm having a downwardly domed portion with resilient fingers terminating at a central orifice are contemplated.

Figure 1:
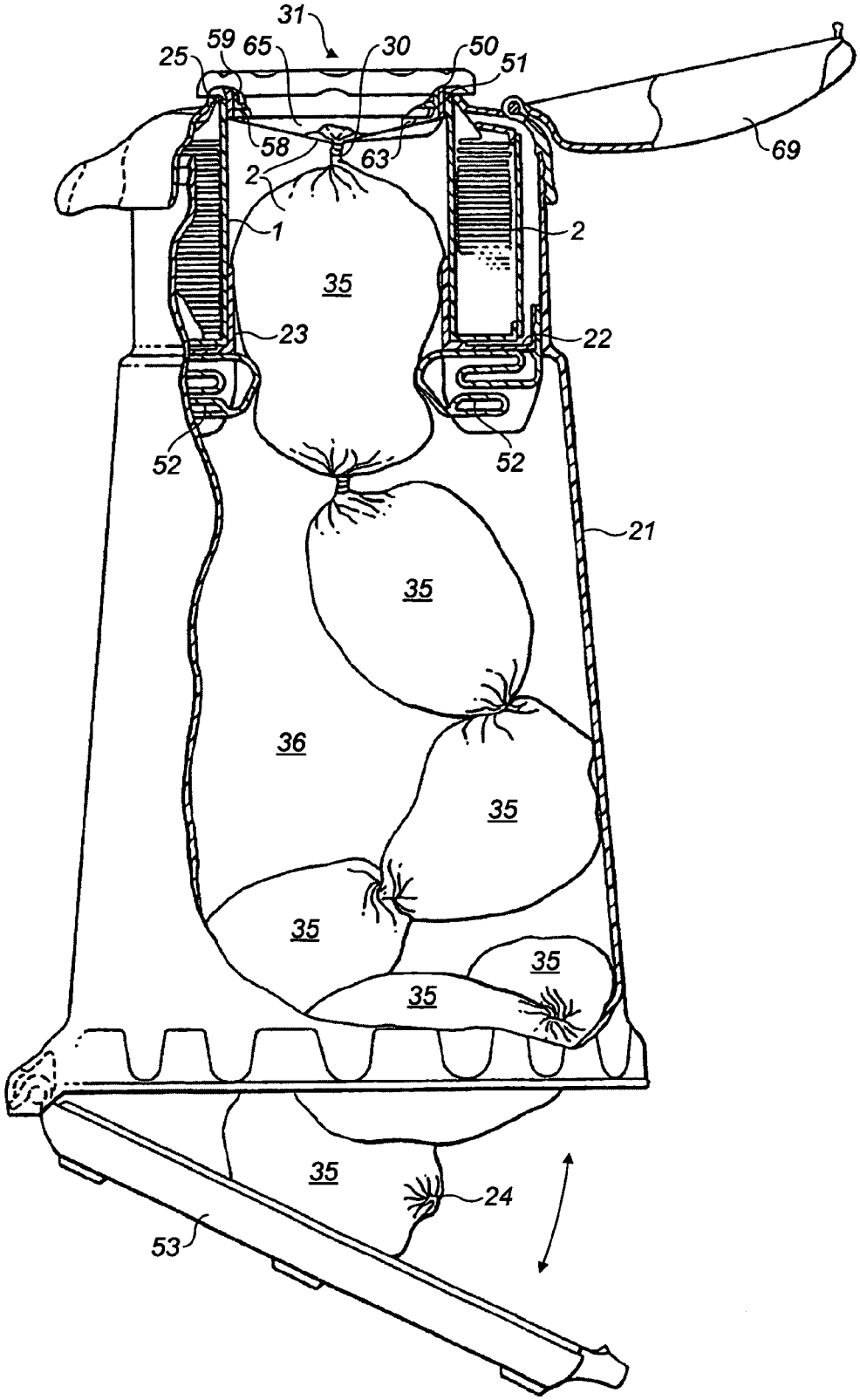
FIG. 1 is a partially cutaway side view of a device of known type.
Figure 2:
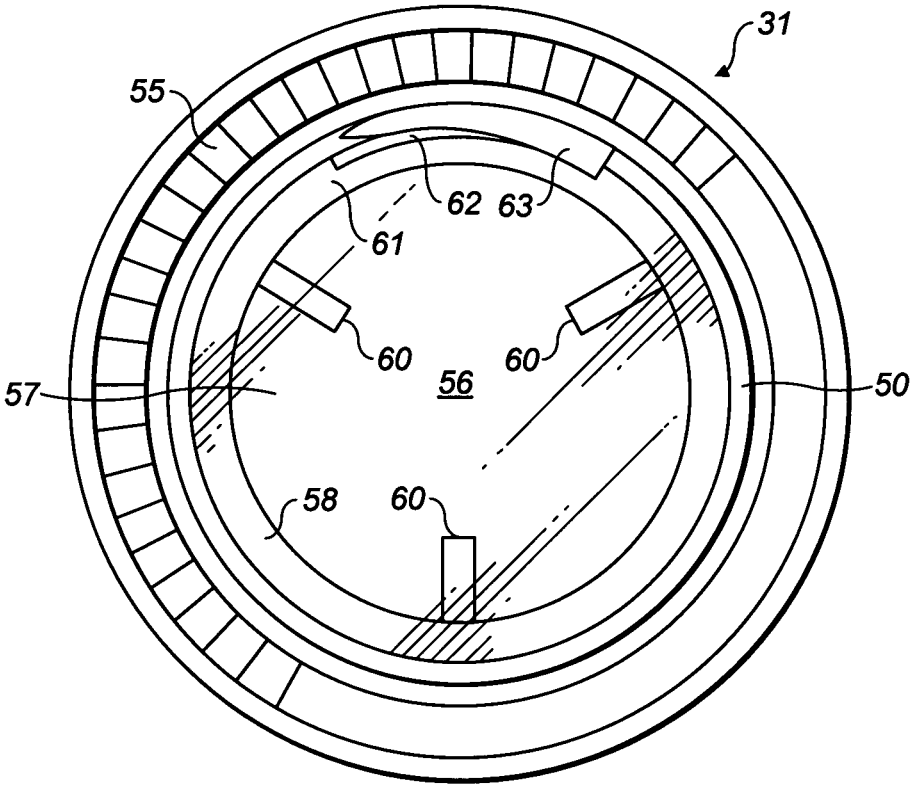
FIG. 2 is an underneath plan view of a cutting device of known type.

Similarly the arrangements described herein can be operable with various alternative cassette configurations. For example a cassette may have inner and outer walls and a base together with an annular flange projecting from the top of the outer wall towards but not all of the way to the inner wall leaving an inner annular gap for film to be dispensed as shown in FIG. 1. Alternatively the cassette may include inner and outer walls and a base and an annular flange projecting outwardly from the inner wall partially towards the outer wall leaving a peripheral gap at the outer edge for film removal. The flange can comprise a fixed or removable part and can act as a funnel.

Figure 7:
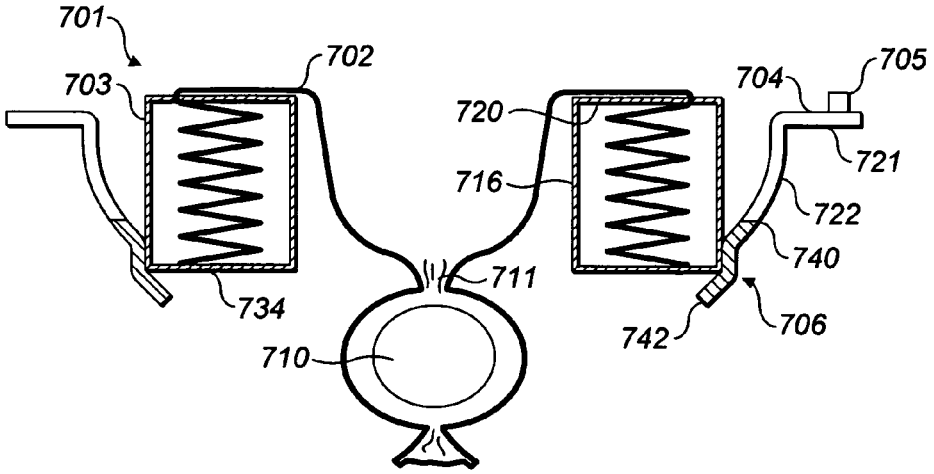
FIG. 7 is a schematic view of a cassette support portion according to a first aspect of a first embodiment of the present invention.

The first aspect of a first embodiment of the invention will now be described with reference to FIG. 7. As discussed above, a cassette 701 for dispensing tubular film 702 to wrap waste 710 has a U-shaped cross section comprising an inner wall 716 and an outer wall 703 connected by an annular base 734. The film is retained in the cassette by a lid or flange 720 which can extend from the inner wall towards the outer wall or vice versa.

As discussed above with reference to FIG. 3, in known systems a projecting rim or flange 106 is provided around the outer wall of the cassette resting on a shoulder 104 projecting from the inner wall of the cassette support or rotate ring 704.

On the other hand according to the embodiment described herein, the support 704 additionally or alternatively includes a cassette support portion or extension 706 angled inwardly from the lower portion of the vertical or annular wall 722 towards a vertical rotation axis of the rotate ring 704 and downwardly from a horizontal rotational plane through the upper portion of the rotate ring 704 forming a frusto conical ring. The vertical rotation axis of the rotate ring 704 runs through the horizontal plane of the rotate ring 704. The cassette support portion in one embodiment can comprise a flexible gripping material such as thermoplastic elastomer or any other suitable resilient or gripping materials such as another elastomer. The cassette support portion includes a support contacting portion 740 at which it meets the remainder of the support and a cassette contacting portion 742 arranged to contact and support the cassette itself. In the embodiment shown the cassette support portion 706 is formed integrally with the rotate ring 704 by co-moulding the flexible gripping material onto the rigid plastic vertical wall at the support contacting portion using, for example, known moulding techniques.

Figure 8:
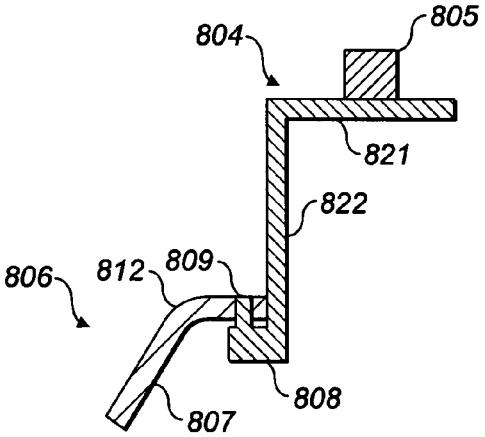
FIG. 8 is a schematic view of part of a cassette support version according to a second aspect of the first embodiment of the present invention.

According to a second, alternative aspect of the first embodiment as shown in FIG. 8 the extension 806 may be formed separately and detachably mountable to the rotate ring 804 comprising for example an outer, flat annular section 812 which is mountable on a lower inwardly extending annular flange 808 of the rotate ring 804. For example in one embodiment the rotate ring 804 has upwardly extending projections 809 on said annular portion 808 for engagement with the annular flange 106 of known cassettes. In that case the annular section 812 can include perforations receiving said projections 809. Hence the cassette contacting portion can be firmly engaged with the rotate ring 804.

The cassette support portion 807 is again angled inwardly and downwardly forming effectively a conical section to engage and grip with the outer wall of a cassette loaded into the device.

It will be seen therefore, that in operation the cassette will rest on the support portion 706 or 806 and, when the rotate ring 704 is turned by the user pulling the handle 705, the support portion 706 or 806 will grip the outer wall of the cassette ensuring that it rotates with the rotate ring 804. As discussed above, this will impart a twist in the tubular film 702 above the waste and seal it within the film.

It will be noted that although a continuous conical inwardly angled support portion is described with reference to FIGS. 7 and 8, this may be replaced by spaced inwardly and downwardly angled projections or fingers extending from the lower end of the rotate ring 704 or 804.

It will further be seen that the resilient gripping portion has the advantages of providing a friction surface of soft material to grip the outer smooth wall 703 of a cassette. In addition or separately, the support portion 706 or 806 is angle downwardly and inwardly to allow fitting of cassettes of varying diameters such that different cassettes can be made to operate with the same rotate ring.

Figure 9:
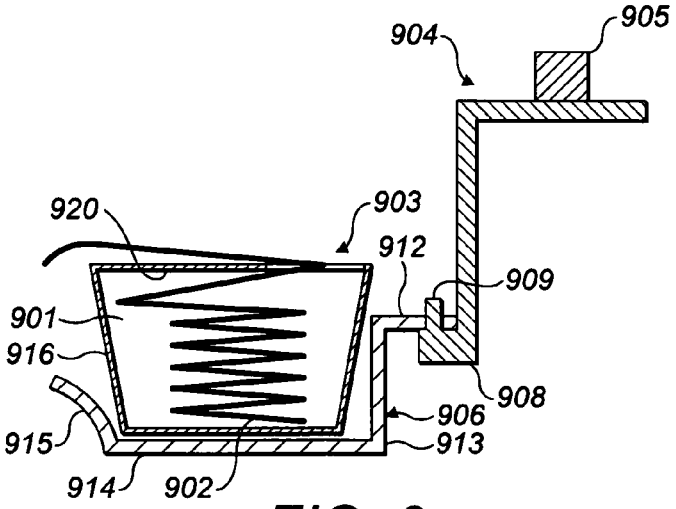
FIG. 9 is a schematic view of a cassette support portion according to a third aspect of the first embodiment of the present invention.

Referring to FIG. 9, a third aspect of the first embodiment is shown. As discussed in more detail above, the cassette 901 typically includes an outer cylindrical wall and an inner cylindrical wall 916. According to the third aspect, therefore, the cassette support portion comprises a vertical outer annular wall 913, a base or lower flat ring 914 projecting inwardly therefrom and a conical cassette contact portion 915 angled so as to extend inwardly and upwardly to engage with the inner wall 916 of the cassette. In the preferred embodiment the extension comprises a flexible, gripping material that provides a friction surface to grip the rigid plastic inner wall 917 as described in more detail above. The cassette support portion 906 can be made integral with the rotate ring 904 or, in the embodiment shown, can be mounted thereon as discussed above with reference to FIG. 8. It will be noted that in all of the embodiments the cassette support portion may be formed of flexible gripping material or the cassette contact portion alone may be formed of resilient material as appropriate. It will also be seen with reference to FIGS. 7 to 9 that the entire cassette support portion may be a continuous body or may comprise spaced fingers. In further aspects portions of the support portion may be continuous and others spaced. For example only the cassette portion contact may formed of fingers and the reminder may be continuous or vice versa, or variants thereon.

Referring to FIGS. 10*a* and 10*b* which show respectively, a side sectional and plan view of a further aspect of the first embodiment the cassette support portion 1014 is formed similarly to that described in FIG. 9 except that cassette contacting portion 915 is replaced by one or more vertically extending fingers 1017 descending upwardly from the ring portion 1014. Each vertical finger 1017 extends upwardly and terminates in a radially outward projection 1018. This is of benefit when the cassette is the type such that the inner wall 1016 thereof has multiple vertical ribs 1019. In particular the projections 1018 will rotate into contact with a respective vertical rib 1019 on the cassette when the rotate ring 1004 is rotated ensuring that correct rotation and twisting of the film is achieved. Yet further where the cassette includes a projection that extends inwardly of or overhangs the inner wall this may rest on a cassette contacting portion of the support portion.

It will be noted that that cassette support portion described with reference to FIGS. 8 to 10 and/or the rotate ring itself can alternatively be moulded, adhered or fixed on the cassette itself for mounting on the rotate ring.

Figure 3:
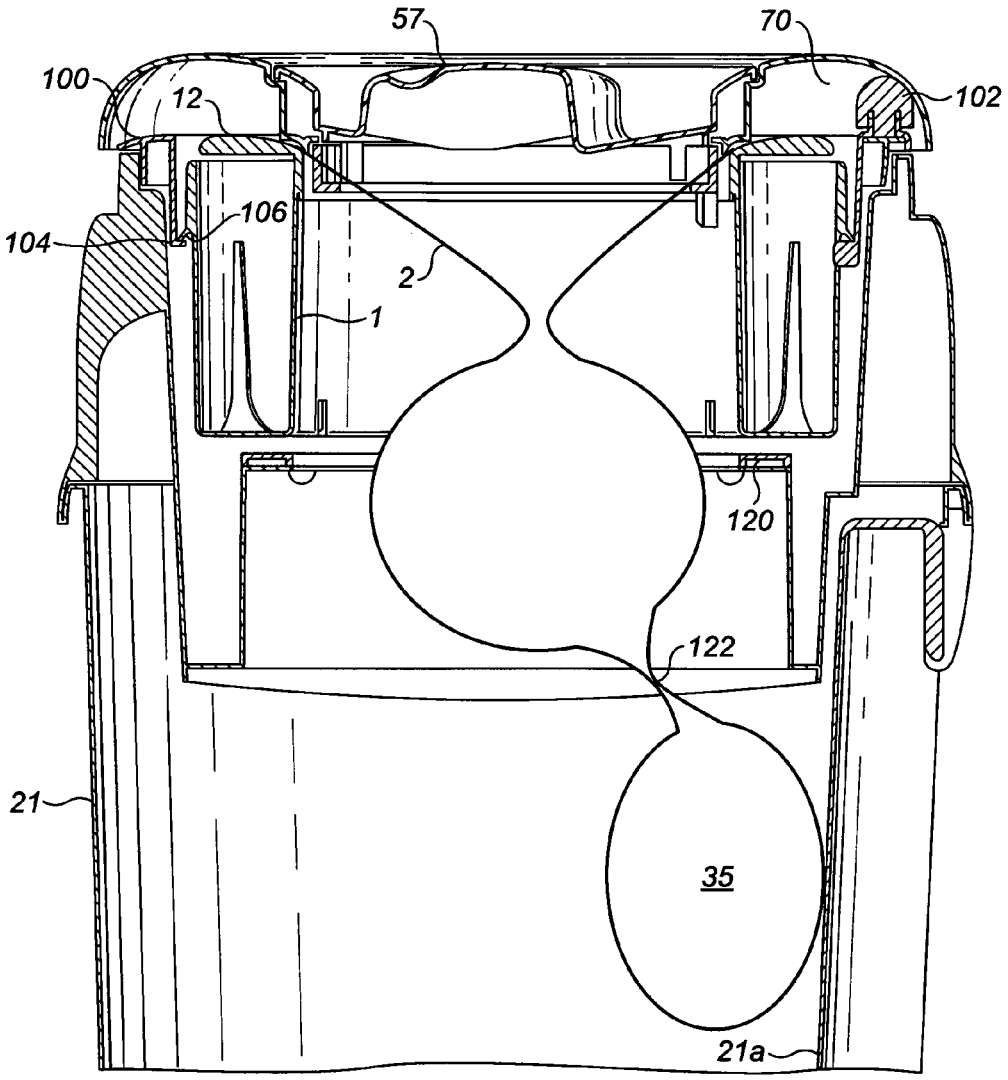
FIG. 3 is a cross sectional view of a waste storage device of known type.
Figure 4:
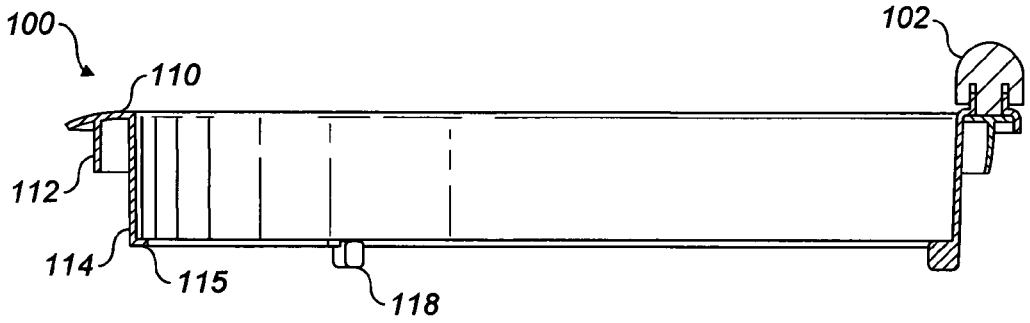
FIG. 4 is a cross section of a rotatable disk for rotating a cassette within the waste storage device of FIG. 3.
Figure 5:
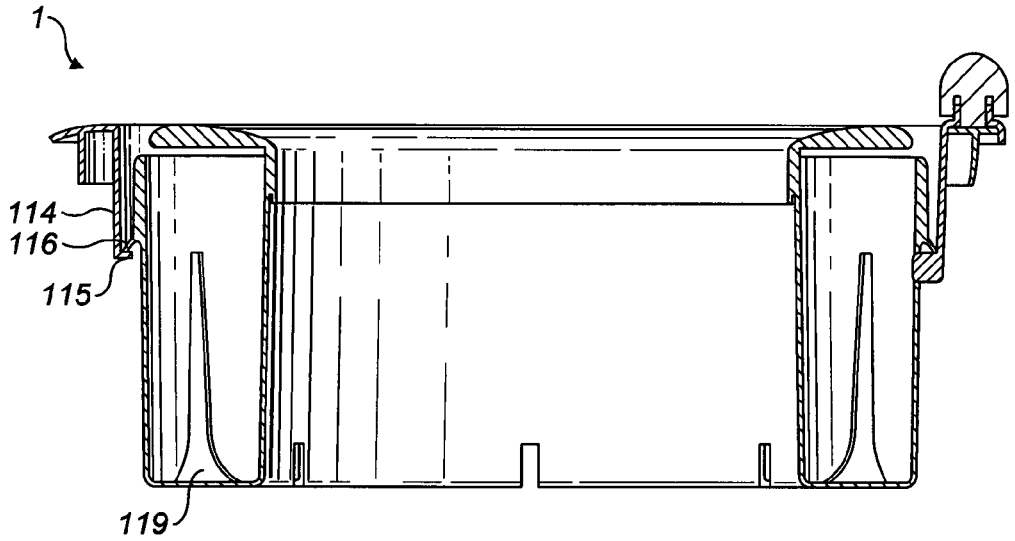
FIG. 5 is a cross sectional view of the rotatable disk of FIG. 4 carrying a cassette.

Turning now to aspects of the second embodiment, discussion is provided of FIGS. 11, 11*a* and 12 showing a waste storage device of the type generally described with reference to FIG. 3 but without the rotate ring 100.

In this case the waste storage device such as 1125 comprises a lower tub 1126 for storing waste that has been sealed in the tubular film 1102. Above the tub 1126 is a cover assembly 1128 which includes a gripping diaphragm 1132 as described with reference to FIG. 3. A hinged lid 1131 with a rotating cutter 1130 is located centrally on the device for engagement with the inner face of the inner wall of the cassette as described in more detail above.

The rotate ring described above effectively centres the cassette such that the core of the cassette is positioned over the diaphragm and a tub on top of the cassette engages correctly and immediately with the cutting device when required. In the absence of a rotate ring, a cassette loaded into the waste storage device will sit on the diaphragm 1132 which is typically made of a flexible gripping material and will therefore inhibit rotation of the cassette. Yet further because the cassette is not centred then it will not be concentric with the cutter 1130 which will hence not operate in the desired manner.

To overcome both of these problems, it is proposed to add a first vertical annular wall 1135 on which the cassette sits on top of the diaphragm 1132. The first vertical annular wall 1135 is substantially perpendicular to the underside 1134 of the cassette and has a diameter less than the outer diameter of the diaphragm 1132. It thereby provides a low surface area to reduce the drag on the cassette when it is rotated.

A second vertical annular wall 1133 may be provided which extends further than the first vertical annular wall 1135 and is also substantially perpendicular to the underside 1134 of the cassette. The second vertical annular wall 1133 has a diameter larger than the first vertical annular wall 1135 and only slightly larger than the outer diameter of the diaphragm on which the cassette rests. By locating the second vertical wall 1133 outside the diaphragm 1132 the cassette will remain concentric with the cutter in the lid. The vertical annular walls 1133 & 1135 may be separate or contiguous with each other, so as to form a single projecting feature on the underside of the cassette, as shown in FIG. 11. Instead of contiguous walls a series of projections may be spaced from one another in a circular configuration or any other appropriate configuration providing rotational support.

It is readily appreciated that the dimensions of the vertically depending annular walls will be dependent on the dimension of diaphragm. In a typical embodiment diaphragm has a circular outer circumference which is mounted on an annular top wall extending from a vertically extending cylindrical wall to define a space through which the waste passes but spaced from the inner wall of the tub. Hence a space is provided for the second vertical wall to extend around the outer circumference of the diaphragm to allow centring thereof.

Alternatively, instead of the one or two vertically depending annular walls 1133 and 1135 an upstanding annular wall 1136 may extend from the circumference of the upper diaphragm support surface 1140, as shown in FIG. 11*a*. The upstanding annular wall 1136 extends substantially perpendicularly to the diaphragm 1132 and may extend from the outer periphery of the diaphragm support surface 1140 or inwardly thereof. Again a series of projections configured as discussed with relation to FIG. 11 may be provided on the alternative. The cassette may have a cut-away or stepped section 1138 at the base of the outer wall 1103 into which the upstanding annular wall 1136 is received, thereby ensuring that the cassette remains concentric with the cutter in the lid. The cut-away section 1138 may be alternatively located at the base of the inner wall 1116. Alternatively, the cassette may have an annular channel (not shown) in the base portion 1134 thereof instead of a cut-away section 1138.

For example, the cut-away section when provided may comprise a stepped outer wall having a reduced diameter at its lower end or base relative to the upper end of the cassette outer wall and/or it may further comprise one or more frustoconical sections reducing in diameter towards the base of the outer wall of the cassette, forming a spigot to be received within the upstanding annular wall.

In an alternative example, the cut-away section when provided may comprise a stepped inner wall having an increased diameter at its lower end or base relative to the upper end of the cassette inner wall and/or it may further comprise one or more frustoconical sections increasing in diameter towards the base of the inner wall of the cassette, forming a spigot to be received within the upstanding annular wall.

In another example, the cut-away section when provided may comprise an annular channel in the base portion 1134 of the cassette, into which the upstanding annular wall can be received.

It is envisaged in the embodiments of FIG. 11 or 11*a* that the cassette could optionally still be rotated by means of a rotate ring 100 as described above with reference to FIG. 3. In this arrangement, the cassette is supported but not centred by the rotate ring 100 whilst the upstanding annular wall 1136 ensures that the cassette remains concentric with the cutter in the lid. Alternatively again the cassette may be supported on an annular wall or similar, but centred and rotated by a non-supporting rotate ring.

Figure 6:
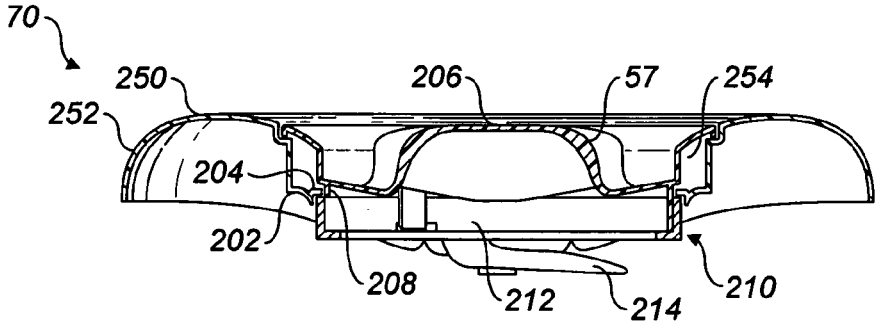
FIG. 6 is a cross section view of a cutter and lid according to the embodiment of FIG. 3.

According to a second aspect of the second embodiment, an alternative means of locating the cassette is provided for example if a diaphragm is not present. As discussed above with reference to FIG. 6, the cutter includes a cutter portion which, in operation, grips the film near the point it leaves the cassette and ensures that the film is held stationary when the cutter is rotated, thereby guaranteeing efficient cutting action. In order to centre the cassette allowing engagement of the cutter with the cassette in the absence of a rotate ring, the lid and/or cassette can be modified as shown in FIG. 12.

In essence, a projection on the underside of the lid grips the film near the point it leaves the cassette and ensures that the film is held stationary when the cutter is in operation. Referring to FIG. 12, the lid 1231 has an extended curved surface 1242 to ensure that as the lid 1231 is closed then the curved surface "leads in" to the central cavity of the cassette. In particular the curved surface comprises a continuous domed annulus or plurality of annular segments or fingers, projecting generally diagonally inwardly and downwardly and convexly curved when viewed from above. In use, when the lid is partially closed, the curved surface 1242 extends far enough inwardly that it engages with the top of the inner wall 1216 of the cassette regardless of how eccentrically the cassette is positioned. Closing the lid further means that the curved surface 1242 pushes on the top of the inner wall, moving it on the supporting surface 1240 and centring it. By completely closing the lid the cassette will be positioned by the curved surface so that it is located concentrically with the cutter 1230 and ready to engage correctly with the blades 1241.

Alternatively, or in addition to the locating effect of the curved surface 1242, the top of the inner wall 1216 of the cassette 1201 may have a second curved surface 1243 which acts to lead the cassette in to a position concentric with the cutter 1230 and the blades 1241. The curved surface 1242 at the top of the inner wall 1216 may be in addition to the flange 1220 that is used to keep the film 1202 within the cassette 1201. Alternatively, the flange 1220 may have a curved surface 1243 located thereon.

It will be seen that the embodiments described allow adaptation to a range of sizes to a cassette in relation to the first embodiment with or without the rotate ring according to the second embodiment.

It will be seen that the device is operated in accordance with the principles described above whereby film is drawn from the cassette when a waste package is inserted and then the cassette is rotated via a rotate ring or manually itself to create a twist.

In a further embodiment the cassette can be operated without the complete twisting function. In this embodiment the diaphragm can grip waste long enough for the user to put a temporary closing twist into the film to seal the waste. The user can then release the twist to deposit the next nappy before reapplying the temporary sealing twist.

It will be appreciated that the arrangements described above can be implemented in any appropriate material and in relation to any dimension and material of device or cassette. Provision of angled or resilient portions according to the first embodiment can be made independently of one another and the additional centring formation according to the second embodiment can be integrally formed or provided as additional attachments as appropriate.

The invention claimed is:

1. A waste storage system comprising:

a container having a top, a bottom, a container wall and a rotate ring, wherein the top and the bottom are connected together by the container wall and the rotate ring rotatably engages the top and extends inside the wall of the container;

the rotate ring of the container having an annular wall with a first wall end and a second wall end and a cassette support portion, the cassette support portion having a first support end and a second support end wherein the first wall end of the annular wall rotatably engages with the top of the container, the second wall end of the annular wall rotatably engages the first support end of the cassette support portion and the cassette support portion extends inwardly from the wall of the container and downwardly from the top of the container such that the cassette support portion forms a frusto conical ring;

a cassette having three surfaces including an inner wall, an outer wall, and an annular base, wherein the inner wall and the outer wall extend upward from the annular base; and wherein the cassette support portion of the container engages at least one of the three surfaces of the cassette such that the rotate ring of the container and the cassette rotate together when the rotate ring is rotated with respect to the container wall.

2. The waste storage system of claim 1 wherein the cassette support portion further comprises a resilient gripping material composed of a material soft enough to grip at least one of the three surfaces of the cassette such that the rotate ring of the container and the cassette rotate together when the rotate ring is rotated with respect to the container wall.

3. The waste storage system of claim 2 wherein the resilient gripping material is composed of an elastomer.

4. The waste storage system of claim 1 wherein the annular wall of the rotate ring is integrally moulded with the cassette support portion of the rotate ring.

5. The waste storage system of claim 1 wherein the annular wall of the rotate ring further comprises a flange at the second wall end extending inwardly from the wall of the container and at least one projection extending towards the top of the container;

wherein the cassette support portion of the rotate ring further comprises an annular section at the first support end extending towards the wall of the container and at least one perforation sized to receive the at least one projection of the annular wall; and wherein the cassette support portion is detachably engaged to the annular wall.

6. The waste storage system of claim 1 wherein the cassette support portion has a maximum diameter greater than a diameter of the outer wall of the cassette and the cassette support portion has a minimum diameter less than the diameter of the outer wall of the cassette, such that the cassette support portion forms the frusto conical ring that allows the cassette support portion to engage cassettes of various diameters.

7. A waste storage system adapted to engage cassettes of various diameter having three surfaces including an inner wall, an outer wall having an outer wall diameter and an annular base wherein the inner wall and the outer wall extend upward from the annular base, the waste storage system comprising:

a container having a top, a bottom, a container wall and a rotate ring, wherein the top and the bottom are connected together by the container wall and the rotate ring rotatably engages with the top and extends inside the wall of the container;

the rotate ring of the container having an annular wall having a first wall end and a second wall end and a cassette support portion, the cassette support portion having a first support end and a second support end wherein the first wall end of the annual wall engages the top of the container, the second wall end of the annular wall engages the first support end of the cassette support portion and the second support end of the cassette support portion extends inwardly from the wall of the container; and wherein the cassette support portion has a maximum diameter greater than the outer wall diameter of the cassette and the cassette support portion has a minimum diameter less than the outer wall diameter of the cassette such that the cassette support portion is adapted to engage at least one of the three surfaces of the cassette and the rotate ring of the container and the cassette rotate together when the rotate ring is rotated with respect to the wall of the container.

8. The waste storage system of claim 7 wherein the cassette support portion extends inwardly from the wall of the container and downwardly from the top of the container such that the cassette support portion forms a frusto conical ring.

9. The waste storage system of claim 7 wherein the cassette support portion further comprises:

a vertical annular wall at the first support end, a conical cassette contact portion at the second support end and a horizontal base extending between the vertical annular wall and the conical cassette contact portion; and wherein the horizontal base of the cassette support portion is adapted to engage the annular base of the cassette and the conical cassette contact portion extends inwardly from the wall of the container and upwardly towards the top of the container such that the rotate ring of the container is adapted to rotate together with the cassette when the rotate ring is rotated with respect to the wall of the container.

10. The waste storage system of claim 9 wherein the annular wall of the rotate ring further comprises a flange at the second wall end extending inwardly from the wall of the container and at least one projection extending towards the top of the container;

wherein the cassette support portion of the rotate ring further comprises an annular section engaged with the vertical annular wall, the annular section extending towards the wall of the container and having at least one perforation sized to receive the at least one projection of the annular wall of the rotate ring; and wherein the cassette support portion is detachably engaged to the annular wall of the rotate ring.

11. The waste storage system of claim 7 wherein the cassette support portion further comprises:

a vertical annular wall at the first support end, a radially outward projection at the second support end that extends towards the wall of the container and is connected to a vertical finger, and a horizontal base extending between the vertical finger and the vertical annular wall;

wherein the radially outward projection extends towards the wall of the container and is adapted to engage a vertical rib on the outer wall of the cassette such that the rotate ring of the container and the cassette rotate together when the rotate ring is rotated with respect to the wall of the container.

12. A waste storage system comprising:

a container having a top, a bottom, a container wall and a rotate ring, wherein the top and the bottom are connected together by the container wall and the rotate ring rotatably engages the top and extends inside the wall of the container;

the rotate ring of the container having an annular wall having a first wall end and a second wall end and a cassette support portion having a first support end and a second support end wherein the first wall end of the annular wall engages the top of the container, the second wall end of the annular wall engages the first support end of the cassette support portion and the cassette support portion extends inwardly from the wall of the container and downwardly from the top of the container such that the cassette support portion forms a frusto conical ring;

a cassette having three surfaces including an inner wall with an inner wall diameter, a circular outer wall with an outer wall diameter and an annular base wherein the inner wall and the outer wall extend upward from the annular base; and wherein the cassette support portion defines an aperture having a maximum diameter greater than the outer wall diameter of the cassette and the cassette support portion has a minimum diameter less than the outer wall diameter of the cassette, such that the cassette support portion engages the cassette.

13. The waste storage system of claim 12 wherein the cassette support portion engages the outer wall of the cassette.

14. A waste storage system comprising:

a cassette having three surfaces including an inner wall, an outer wall having an outer wall diameter and an annular base wherein the inner wall and the outer wall extend upward from the annular base;

a container having a top, a bottom, a container wall and a rotate ring, wherein the top and the bottom are connected together by the container wall and the rotate ring rotatably engages the top and extends inside the wall of the container;

the rotate ring of the container having an annular wall with a first wall end and a second wall end and a cassette support portion having a vertical annular wall with a first support end, a conical cassette portion with a second support end, and a horizontal base extending between the vertical annular wall and the conical cassette portion;

wherein the second wall end of the annular wall engages with the first support end of the cassette portion;

wherein the conical cassette portion of the cassette support portion extends upwardly towards the top of the container and inwardly from the wall of the container; and wherein the annular base of the cassette engages the horizontal base of the cassette support portion and the inner wall of the cassette engages the conical cassette portion of the cassette support portion, such that the rotate ring of the container and the cassette rotate together when the rotate ring is rotated with respect to the container wall.

15. The waste storage system of claim 14 wherein the annular wall of the rotate ring further comprises a flange at the second wall end extending inwardly from the container wall and at least one projection extending towards the top of the container;

wherein the cassette support portion of the rotate ring further comprises an annular section engaged with the vertical annular wall, the annular section extending towards the container wall and having at least one perforation sized to receive the at least one of projection of the annular wall of the rotate ring; and wherein the cassette support portion is detachably engaged to the annular wall of the rotate ring.

* * * * *